US010442063B2

(12) United States Patent
Wu

(10) Patent No.: US 10,442,063 B2
(45) Date of Patent: Oct. 15, 2019

(54) SELF-FORMING SOCKET ASSEMBLY

(71) Applicant: Ming-Cheng Wu, Taichung (TW)

(72) Inventor: Ming-Cheng Wu, Taichung (TW)

( * ) Notice: Subject to any disclaimer, the term of this patent is extended or adjusted under 35 U.S.C. 154(b) by 204 days.

(21) Appl. No.: 15/661,166

(22) Filed: Jul. 27, 2017

(65) Prior Publication Data

US 2019/0030693 A1 Jan. 31, 2019

(51) Int. Cl.

| | |
|---|---|
| ***B25B 23/00*** | (2006.01) |
| ***B25B 15/00*** | (2006.01) |
| ***B25B 13/08*** | (2006.01) |
| ***B25B 13/10*** | (2006.01) |

(52) U.S. Cl.

CPC ..... *B25B 23/0035* (2013.01); *B25B 13/08* (2013.01); *B25B 13/105* (2013.01); *B25B 15/005* (2013.01)

(58) Field of Classification Search

CPC ... B25B 13/105; B25B 23/0035; B25B 13/08; B25B 15/005

See application file for complete search history.

(56) References Cited

U.S. PATENT DOCUMENTS

| | | | | |
|---|---|---|---|---|
| 3,674,070 | A * | 7/1972 | Mahoney | B25B 13/105 81/185 |
| 5,287,778 | A * | 2/1994 | Cook | B25B 13/105 269/266 |
| 6,085,619 | A * | 7/2000 | Blake | B25B 23/0035 81/177.85 |
| 6,092,443 | A * | 7/2000 | Zayat, Jr. | B25B 13/105 81/124.5 |
| 6,098,507 | A | 8/2000 | Lin | |
| 7,290,469 | B2 | 11/2007 | Walters et al. | |
| 2017/0266789 | A1 * | 9/2017 | Berman | B25B 7/02 |

* cited by examiner

*Primary Examiner* — David B. Thomas
(74) *Attorney, Agent, or Firm* — Rosenberg, Klein & Lee

(57) ABSTRACT

A self-forming socket assembly includes a socket having an operational end and a connection end. A recess is defined in the operational end and a passage is defined in the connection end and communicates with the recess. A board is rested on a shoulder in the recess and includes a central hole and multiple bores. Each bore has a gripping pin retractably inserted therein, and includes a polygonal section. A bit movably extends through the passage of the socket and the central hole of the board. The bit is positioned in the central hole of the board or positioned to protrude beyond the recess.

7 Claims, 8 Drawing Sheets

SELF-FORMING SOCKET ASSEMBLY

BACKGROUND OF THE INVENTION

1. Fields of the Invention

The present invention relates to a self-forming socket assembly, and more particularly, to a self-forming socket assembly having a movable and replaceable screwdriver bit to deal with screw heads of different shapes.

2. Descriptions of Related Art

The conventional self-forming sockets known to applicant are disclosed in U.S. Pat. No. 7,290,469 and U.S. Pat. No. 6,098,507. U.S. Pat. No. 7,290,469 discloses a self-forming socket and comprises a plurality of retractable gripping pins bundled in parallel and held in a frame within a housing. The frame is positioned axially within the housing by radially extending, elongated hold elements that are positioned circumferentially around the housing. Slots in the housing exterior allow efficient inspection of the position of holes into which the hold elements are installed. A collar with shelf around the center pin protects the bias spring for the pin from over-compression. The gripping pins may be held to the frame by spring clips and/or a resilient O-ring. An adaptor is attached wherein a secondary operation is used to remove the adaptor from the square end of the socket. The self-forming socket is suited for use with valves and controls for water, gas, sewage conduits and piping.

However, the disclosed self-forming socket can only be used on the hexagonal head of a bolt due to the fixed shape of the socket. When facing a screw head having a keystone slot or a Phillips slot, the disclosed self-forming socket cannot be functionally operated as desired.

The present invention intends to provide a self-forming socket assembly having a movable and replaceable screwdriver bit to provide more functions.

SUMMARY OF THE INVENTION

The present invention relates to a self-forming socket assembly and comprises a socket having an operational end and a connection end respectively formed on two ends thereof. A recess is defined in the operational end and a shoulder extends from the inner periphery of the recess. A passage is defined in the connection end and communicates with the recess. A board is located in the recess and rested on the shoulder. The board has a central hole and multiple bores which are located around the central hole. Each bore has a gripping pin inserted therein, and each gripping pin has a shank and a polygonal section is formed on the first end of the shank. The second end of the shank extends through the bore corresponding thereto and is connected with a restriction member to secure the gripping pin to the board. Each shank has a first spring mounted thereto which is biased between one end of the polygonal section and the board. A bit movably extends through the passage of the socket and the central hole of the board. The bit has a work end which is positioned in the central hole of the board or positioned to protrude beyond the recess.

Preferably, the inner diameter of the recess is larger than that of the passage.

Preferably, the diameter of the shank is smaller than that of the polygonal section of each of the gripping pins. The polygonal section has a hexagonal cross section.

Preferably, the connection end of the socket includes a hexagonal section which is adapted to be clamped by a wrench.

Preferably, the bit includes a groove defined in the outer periphery thereof. A bead is movably engaged with the wall of the passage of the connection end. When the work end of the bit is positioned in the central hole of the board, the bead is engaged with the groove to position the bit. When the work end of the bit protrudes beyond the recess, the bead contacts against the outer periphery of the bit to position the bit.

Preferably, a sleeve is mounted to outside of the connection end and includes a ridge extending from the inner periphery of the sleeve. A second spring is received in the sleeve and biased between the ridge and a clip connected to one end of the sleeve. The ridge has an inclined face and an end face. When the end face of the ridge contacts the bead, the bead is pushed inward. When the sleeve is moved to compress the second spring, the end face moves away from the bead and the bead moves outward along the inclined face. When the sleeve is released, the second spring pushes the sleeve and the inclined face guides the bead inward.

The primary object of the present invention is to provide a self-forming socket assembly which has a bit movably connected thereto so as to perform different functions to deal with different types of heads of screws.

Another object of the present invention is to provide a self-forming socket assembly wherein the bit does not affect the operation of the socket.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
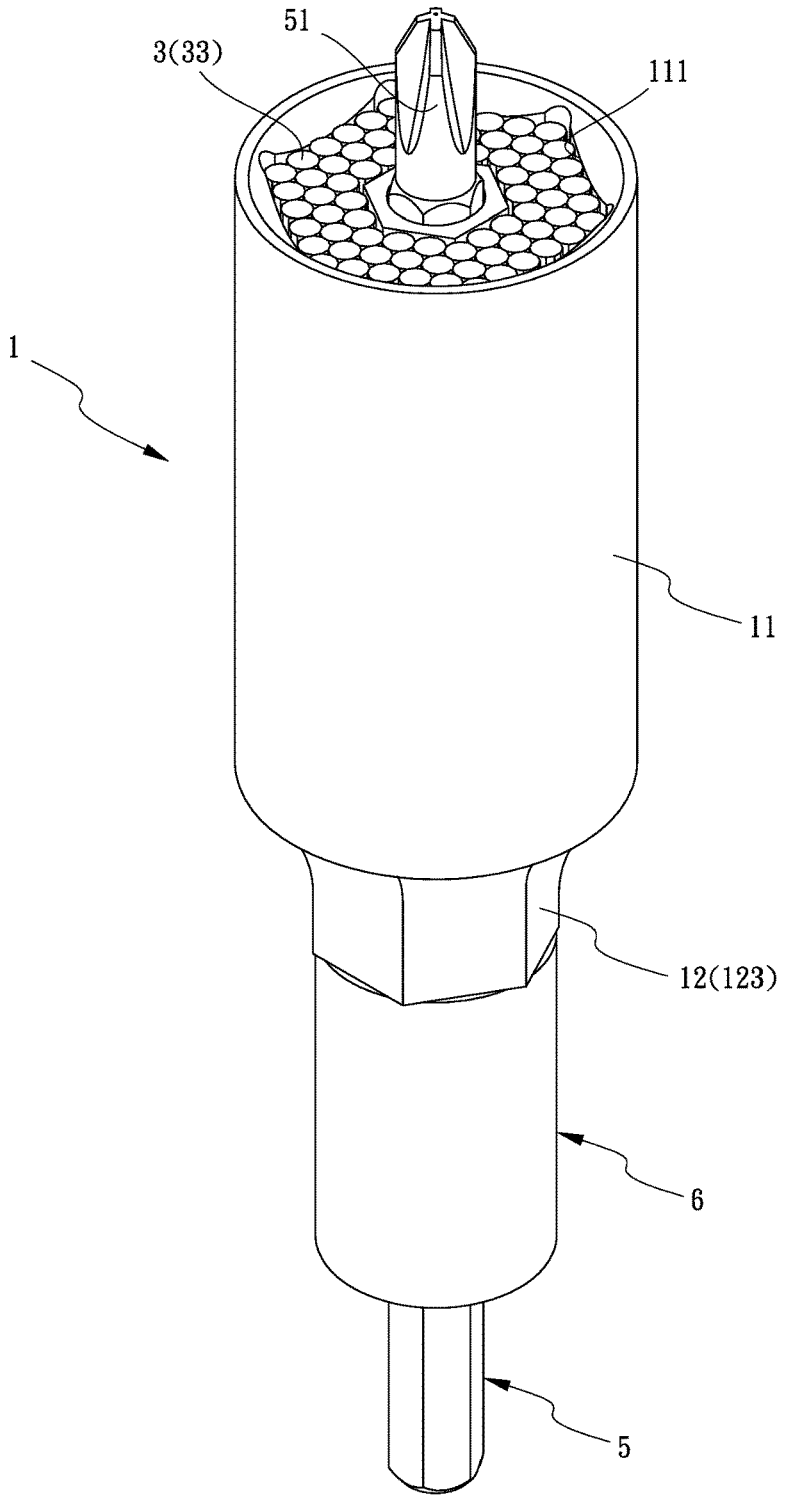
FIG. 1 is a perspective view to show the self-forming socket assembly of the present invention.
Figure 2:
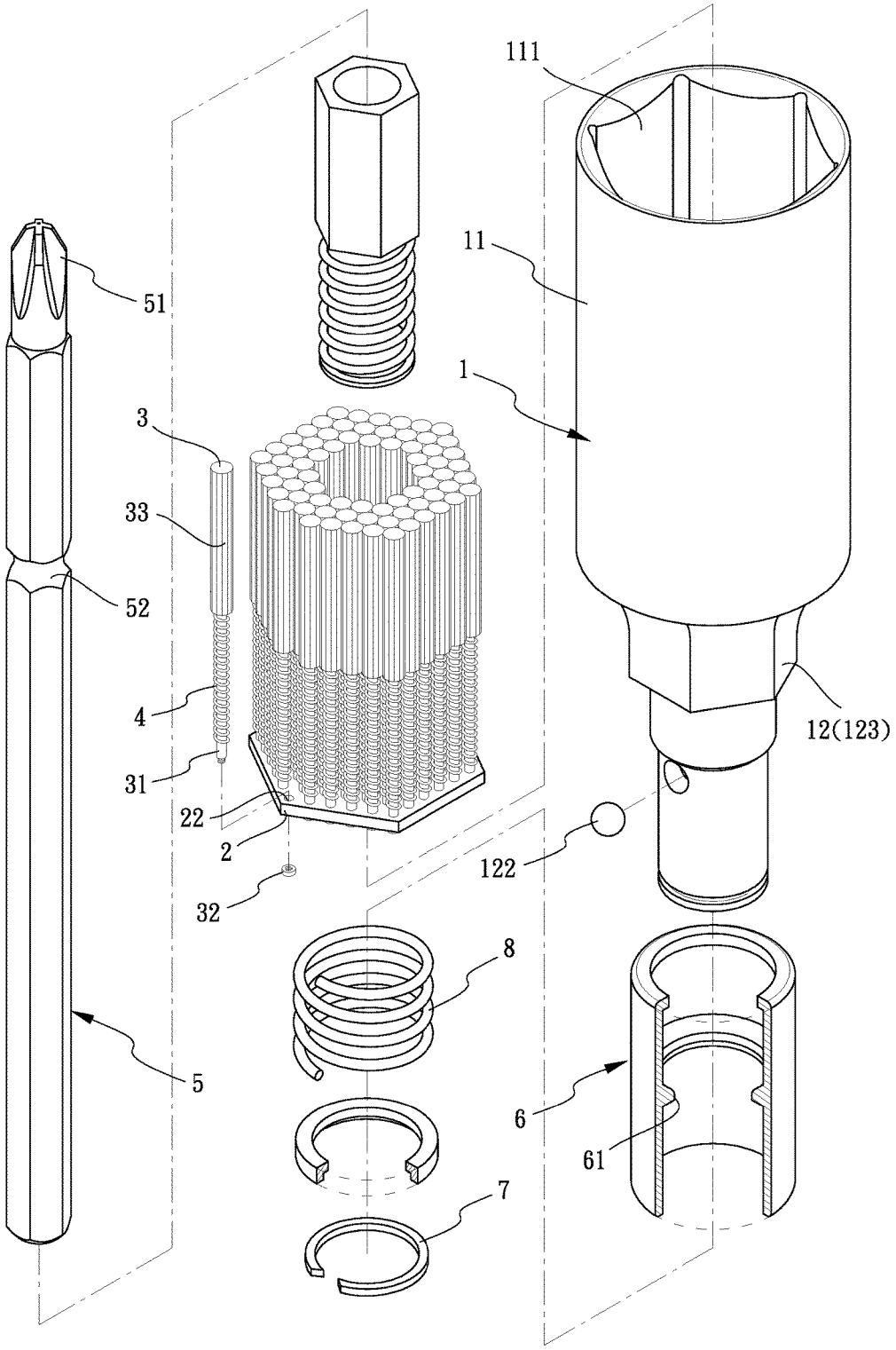
FIG. 2 is an exploded view of the self-forming socket assembly of the present invention.
Figure 3:
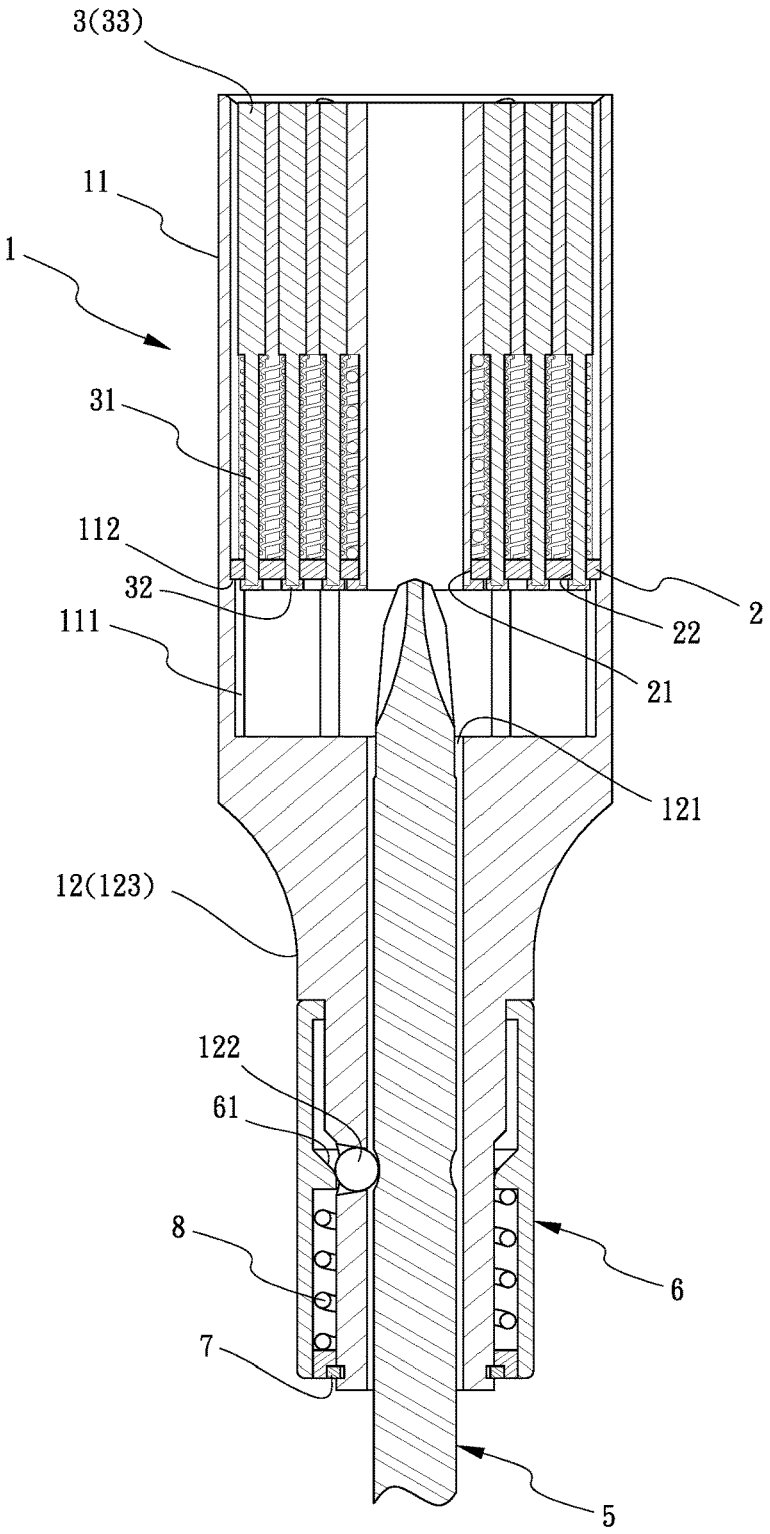
FIG. 3 is a cross sectional view of the self-forming socket assembly of the present invention.
Figure 7:
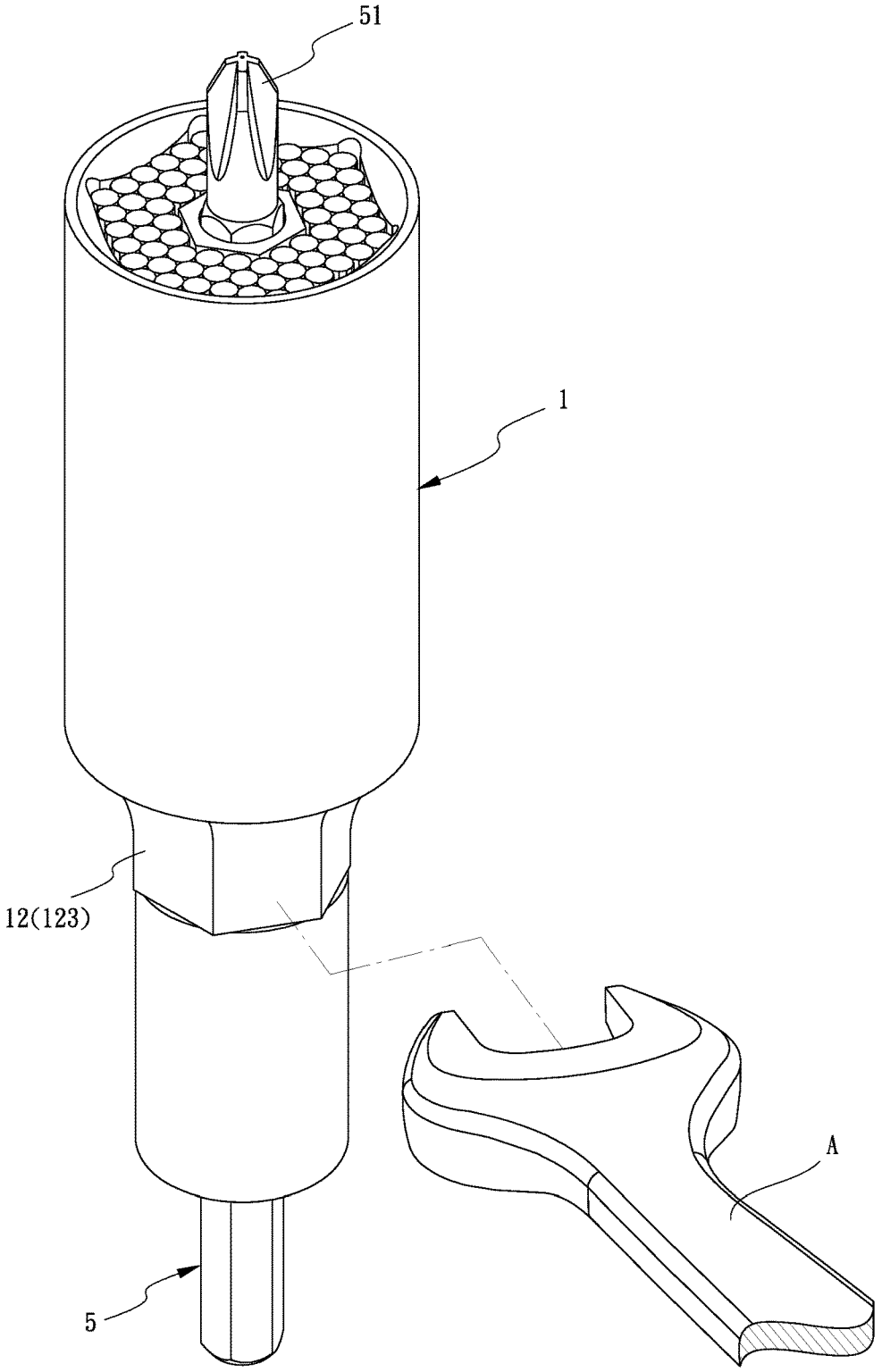
FIG. 7 shows that a wrench is about to clamp the hexagonal section of the connection end of the self-forming socket assembly of the present invention.

Referring to FIGS. 1 to 3, the self-forming socket assembly of the present invention comprises a socket 1 having an operational end 11 and a connection end 12 respectively formed on two ends thereof. A recess 111 is defined in the operational end 11 and a shoulder 112 extends inward from the inner periphery of the recess 111. A passage 121 is defined in the connection end 12 and communicates with the recess 111. The inner diameter of the recess 111 is larger than that of the passage 121. The connection end 12 of the socket 1 includes a hexagonal section 123 which is adapted to be clamped by a wrench "A" as shown in FIG. 7. A board 2 is located in the recess 111 and rested on the shoulder 112. The board 2 has a central hole 21 and multiple bores 22 which are located around the central hole 21. Each bore 22 has a gripping pin 3 inserted therein, and each gripping pin 3 has a shank 31, and a polygonal section 33 is formed on the first end of the shank 31. The second end of the shank extends through the bore corresponding thereto and is connected with a restriction member 32 to secure the gripping pin to the board. The diameter of the shank 31 is smaller than that of the polygonal section 33 of each of the gripping pins 3. The polygonal section 33 has a hexagonal cross section. Each shank 31 has a first spring 4 mounted thereto which is biased between one end of the polygonal section 33 and the board 2.

A bit 5 replaceably and movably extends through the passage 121 of the socket 1 and the central hole 21 of the board 2. The bit 5 has a work end 51 which is positioned in the central hole 21 of the board 2 or positioned to protrude beyond the recess 111. The bit 5 includes a groove 52 defined in the outer periphery thereof. A bead 122 is movably engaged with the wall of the passage 121 of the connection end 12. When the work end 51 of the bit 5 is positioned in the central hole 21 of the board 2, the bead 122 is engaged with the groove 52 to position the bit 5 as shown in FIG. 3.

A sleeve 6 is mounted to outside of the connection end 12 and includes a ridge 61 extending from the inner periphery of the sleeve 6. A second spring 8 is received in the sleeve 6 and biased between the ridge 61 and a clip 7 connected to one end of the sleeve 6. The ridge 61 has an inclined face and an end face.

Figure 4:
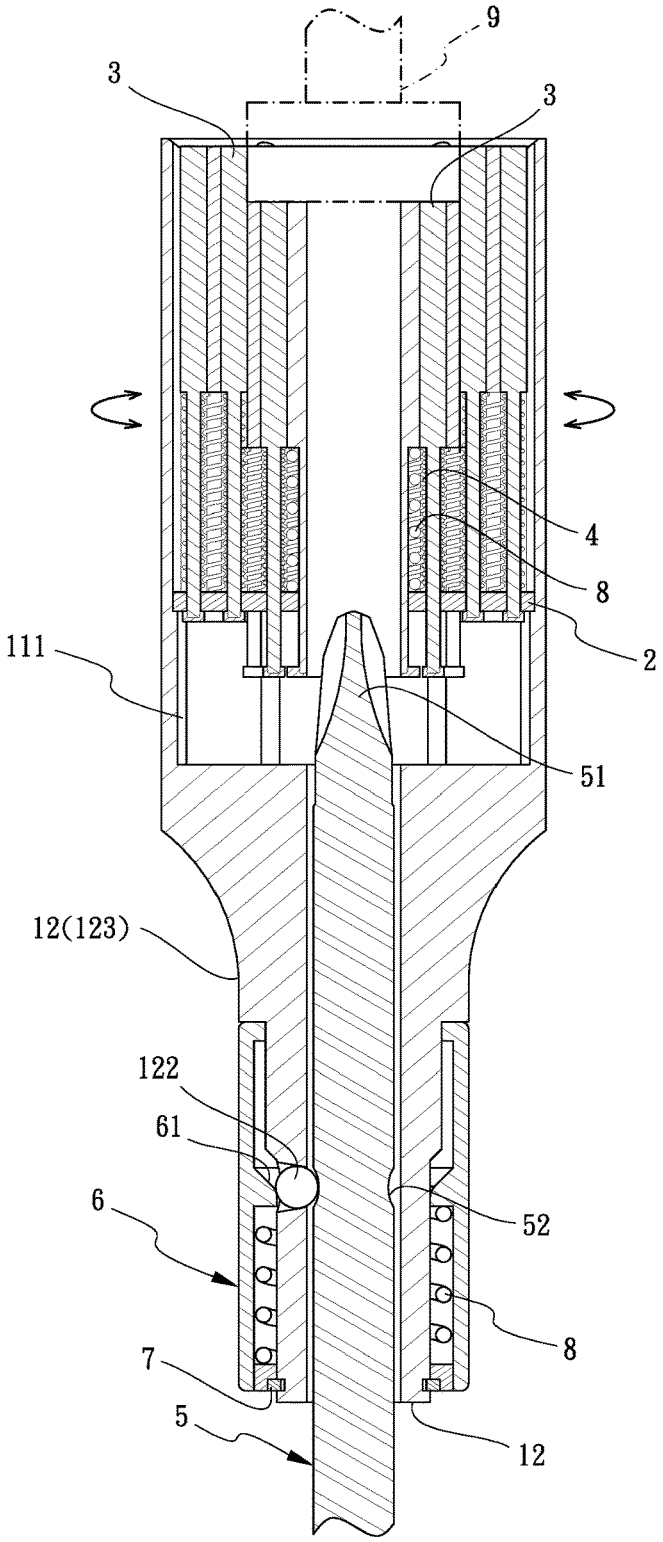
FIG. 4 is a cross sectional view of the self-forming socket assembly of the present invention, wherein an object is inserted into the socket by retracting the gripping pins.

As shown in FIG. 4, when an object 9 is inserted into the operational end 11 of the socket 1, the object 9 compresses the first springs 4 on the gripping pins 3 that are correspondent to the area of the object 9. Those gripping pins 3 that are not retracted grip the object 9 firmly. When the socket 1 is rotated, the object 9 is co-rotated with the rotation of the socket 1. In this status, the bit 5 is positioned by the engagement between the bead 122 and the groove 52. The bead 122 is pushed by the end face of the ridge 61 and is securely engaged with the groove 52 of the bit 5.

Figure 5:
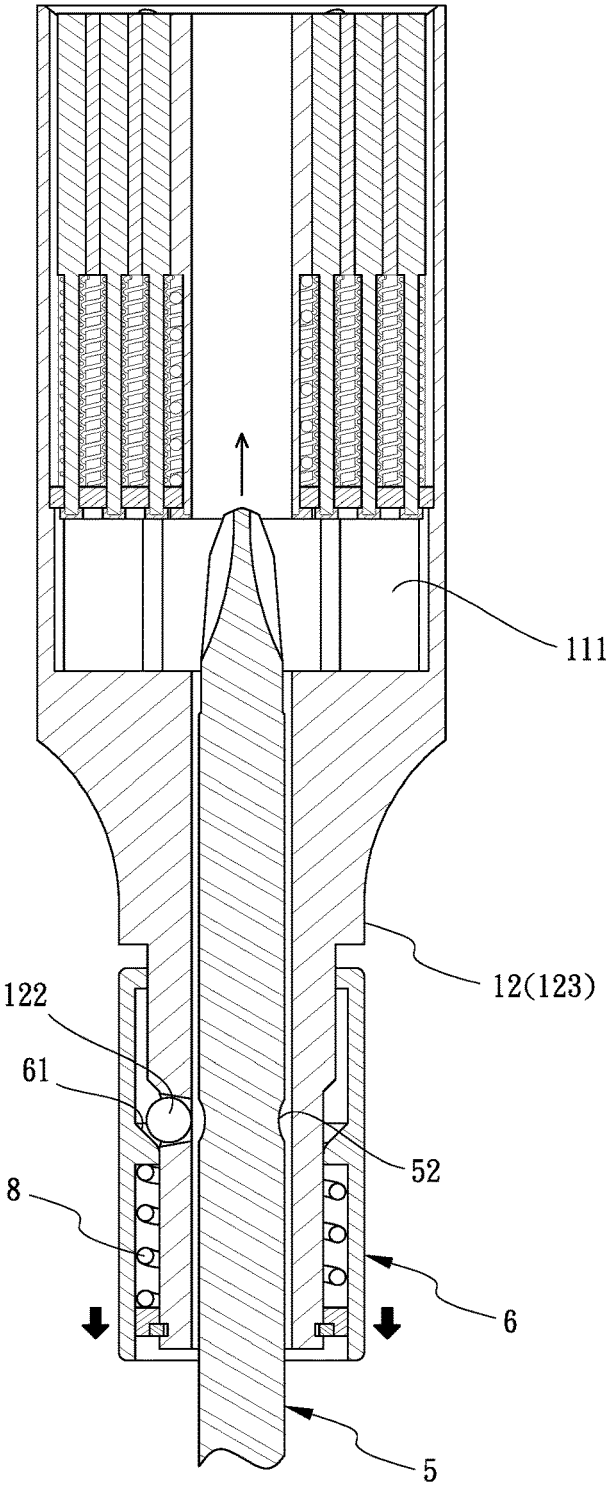
FIG. 5 is a cross sectional view of the self-forming socket assembly of the present invention, wherein the sleeve is pulled downward to disengage the bead from the groove of the bit.
Figure 6:
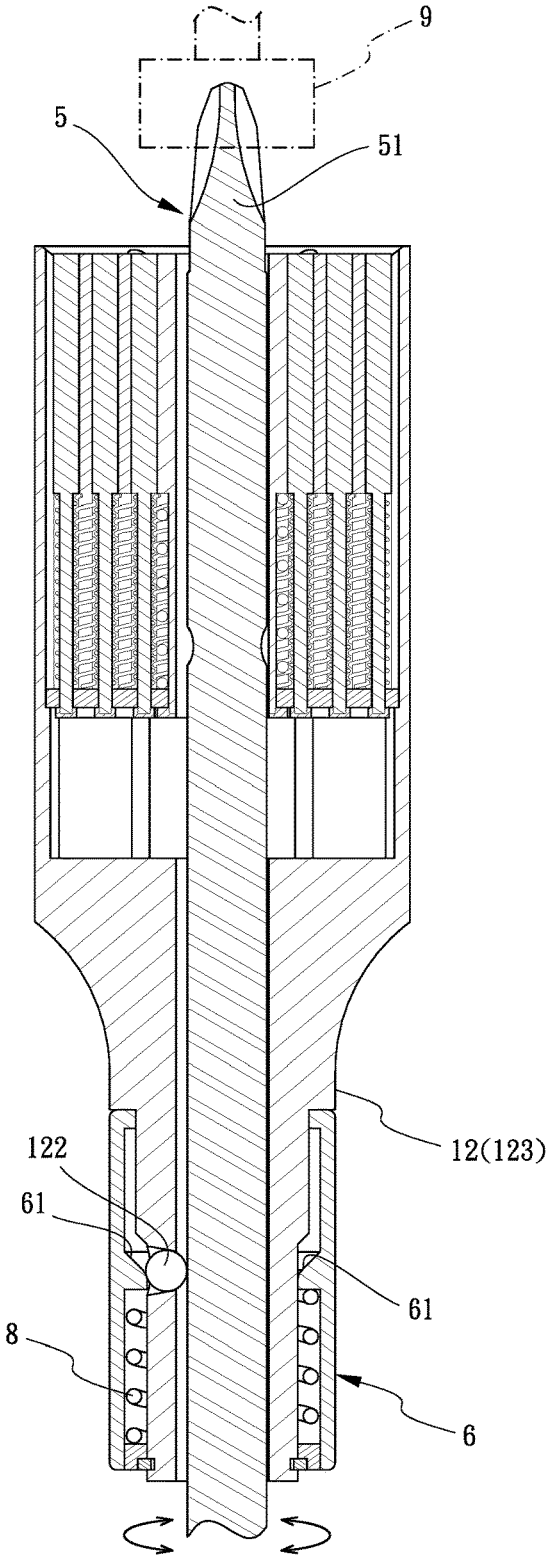
FIG. 6 is a cross sectional view of the self-forming socket assembly of the present invention, wherein the bead contacts against the bit, and the bit is rotated to drive an object.

As shown in FIG. 5, when the sleeve 6 is pulled downward to compress the second spring 8, the end face moves away from the bead 122 and the bead 122 moves outward along the inclined face. Therefore, the bit 5 can be moved upward to allow the work end 51 to protrude beyond the recess 111 so as to be engaged with the head of the object 9 as shown in FIG. 6. When the sleeve 6 is released, the second spring 8 pushes the sleeve 6 upward and the inclined face guides the bead 122 inward until the end face contacts the bead 122 again. The bit 5 is rotated to drive the object 9. The rotation of the socket 1 can be made by using a wrench "A" as shown in FIG. 7 to work more effectively.

The depth that the gripping pins 3 is made to be more than 2 cm or even longer to drive the objects 9 when necessary.

Figure 8:
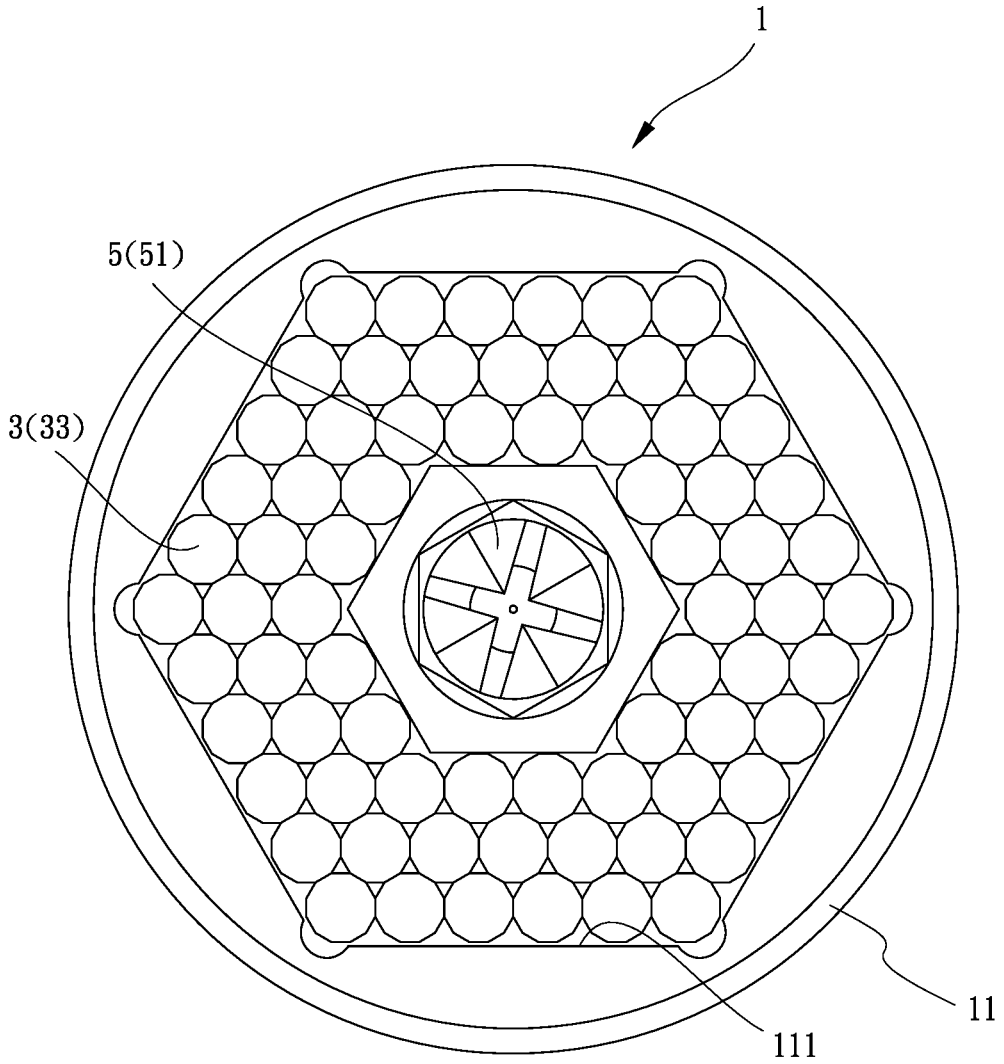
FIG. 8 is an end view to show the work end of the bit and the gripping pins.

As shown in FIG. 8, the polygonal section 33 of each of the gripping pins 3 may have a twelve-sided outside so as to reduce gaps between the gripping pins 3 at the outer peripheral position of the bundled gripping pins 3 and the inside of the recess 111.

While we have shown and described the embodiment in accordance with the present invention, it should be clear to those skilled in the art that further embodiments may be made without departing from the scope of the present invention.

What is claimed is:

1. A self-forming socket assembly comprising:

a socket (1) having an operational end (11) and a connection end (12) respectively formed on two ends thereof, a recess (111) defined in the operational end (11) and a shoulder (112) extending from an inner periphery of the recess (111), a passage (121) defined in the connection end (12) and communicated with the recess (111);

a board (2) located in the recess (111) and rested on the shoulder (112), the board (2) having a central hole (21) and multiple bores (22) which are located around the central hole (21), each bore (22) having a gripping pin (3) inserted therein, each gripping pin (3) having a shank (31), a polygonal section (33) formed on a first end of the shank (31), a second end of the shank (31) extending through the bore (22) corresponding thereto and being connected with a restriction member (32) to secure the gripping pin (3) to the board (2), each shank (31) having a first spring (4) mounted thereto which is biased between one end of the polygonal section (33) and the board (2);

a bit (5) movably extending through the passage (121) of the socket (1) and the central hole (21) of the board (2), the bit (5) having a work end (51) which is positioned in the central hole (21) of the board (2) or positioned to protrude beyond the recess (111).

2. The self-forming socket assembly as claimed in claim 1, wherein an inner diameter of the recess (111) is larger than that of the passage (121).

3. The self-forming socket assembly as claimed in claim 1, wherein a diameter of the shank (31) is smaller than that of the polygonal section (33) of each of the gripping pins (3), the polygonal section (33) has a hexagonal cross section.

4. The self-forming socket assembly as claimed in claim 2, wherein a diameter of the shank (31) is smaller than that of the polygonal section (33) of each of the gripping pins (3), the polygonal section (33) has a hexagonal cross section.

5. The self-forming socket assembly as claimed in claim 1, wherein the connection end (12) of the socket (1) includes a hexagonal section (123) which is adapted to be clamped by a wrench.

6. The self-forming socket assembly as claimed in claim 1, wherein the bit (5) includes a groove (52) defined in an outer periphery thereof, a bead (122) is movably engaged with a wall of the passage (121) of the connection end (12), when the work end (51) of the bit (5) is positioned in the central hole (21) of the board (2), the bead (122) is engaged with the groove (52) to position the bit (5), when the work end (51) of the bit (5) protrudes beyond the recess (111), the bead (122) contacts against the outer periphery of the bit (5) to position the bit (5).

7. The self-forming socket assembly as claimed in claim 6, wherein a sleeve (6) is mounted to outside of the connection end (12) and includes a ridge (61) extending from an inner periphery of the sleeve (6), a second spring (8) is received in the sleeve (6) and biased between the ridge (61) and a clip (7) connected to an end of the sleeve (6), the ridge (61) has an inclined face and an end face, when the end face of the ridge contacts the bead (122), the bead (122) is pushed inward, when the sleeve (6) is moved to compress the second spring (8), the end face moves away from the bead (122) and the bead (122) moves outward along the inclined face, when the sleeve (6) is released, the second spring (8) pushes the sleeve (6) and the inclined face guides the bead (122) inward.

* * * * *